US008591022B2

(12) United States Patent
Chuang et al.

(10) Patent No.: US 8,591,022 B2
(45) Date of Patent: Nov. 26, 2013

(54) PRINTING APPARATUS WITH PIVOTABLE DUPLEXING UNIT

(75) Inventors: Siew Pern Chuang, Singapore (SG); Richard A. Murray, San Diego, CA (US); Venkatesh Mysore Nagaraja Rao, Singapore (SG); Keng Leong Ng, Singapore (SG)

(73) Assignee: Eastman Kodak Company, Rochester, NY (US)

( * ) Notice: Subject to any disclaimer, the term of this patent is extended or adjusted under 35 U.S.C. 154(b) by 237 days.

(21) Appl. No.: 13/118,651

(22) Filed: May 31, 2011

(65) Prior Publication Data

US 2012/0306978 A1 Dec. 6, 2012

(51) Int. Cl.
*B41J 2/01* (2006.01)

(52) U.S. Cl.
USPC ..... 347/104

(58) Field of Classification Search
None
See application file for complete search history.

(56) References Cited

U.S. PATENT DOCUMENTS

| | | | | |
|---|---|---|---|---|
| 4,825,245 | A | 4/1989 | Fukae et al. | |
| 4,884,110 | A | 11/1989 | Tsurubuchi | |
| 6,564,019 | B2 | 5/2003 | Ahn et al. | |
| 7,350,902 | B2 | 4/2008 | Dietl et al. | |
| 7,536,133 | B2 * | 5/2009 | Kang | 399/124 |
| 7,561,823 | B2 | 7/2009 | Johnson | |
| 7,744,077 | B2 | 6/2010 | Buxton et al. | |
| 2002/0114634 | A1 * | 8/2002 | Ahn et al. | 399/13 |
| 2007/0057448 | A1 | 3/2007 | Hiura | |

FOREIGN PATENT DOCUMENTS

| | | |
|---|---|---|
| JP | 2001-097603 | 4/2001 |
| JP | 2005-070070 | 3/2003 |
| JP | 2003-146476 | 5/2003 |

* cited by examiner

*Primary Examiner* — Stephen Meier
*Assistant Examiner* — Tracey McMillion
(74) *Attorney, Agent, or Firm* — Eugene I. Shkurko; Amit Singhal

(57) ABSTRACT

A pivotable duplexing unit is attached to the wall of a printer using a hinge having an axis that is substantially perpendicular to the base. A latch and catch holds the pivotable duplexing unit in a closed position relative to the wall of the printing apparatus. The wall includes a support member for the hinge, and the pivotable duplexing unit further includes a pin for pivoting in a support member of the hinge. The support member includes a bearing surface that is substantially parallel to the base. The pin member includes an end that makes pivotable contact with the bearing surface.

21 Claims, 21 Drawing Sheets

PRINTING APPARATUS WITH PIVOTABLE DUPLEXING UNIT

CROSS REFERENCE TO RELATED APPLICATIONS

Reference is made to commonly assigned, co-pending U.S. Patent Applications:

Ser. No. 13/118,656 by Chuang et al. filed of even date herewith entitled "Printing Method With Pivotable Duplexing Unit";

Ser. No. 13/118,671 by Murray et al. filed of even date herewith entitled "Printing Apparatus with Pivotable Cleanout Member"; and Ser. No. 13/118,683 by Murray et al. filed of even date herewith entitled "Method Of Pivoting Cleanout Member", the disclosures of which are incorporated herein by reference in their entireties.

FIELD OF THE INVENTION

The present invention relates generally to a media path for a printing apparatus, and more particularly to a duplexing unit for reversing a side of the media facing a print region.

BACKGROUND OF THE INVENTION

Many types of printing apparatus are capable of printing only on a single side of the recording medium. However, the desirability of saving paper (or other types of printing media) by printing on both sides is widely recognized. A variety of duplexing designs have previously been disclosed for reversing a side of the media facing the print region after a first side has been printed, in order to allow printing on the opposite side.

In some low-cost printers, as described in U.S. Pat. No. 7,561,823, a duplexing unit is provided as a removable auxiliary unit that the user can decide whether or not to purchase, according to his printing needs. If the user does purchase the auxiliary duplexing unit, he needs to install it himself, thus increasing the complexity of the setting up of the printing apparatus.

For permanently attached duplexing units it can be advantageous to make the inner portions of the media path accessible in order to facilitate the clearing of paper jams by the user. U.S. Pat. Nos. 4,825,245, 4,884,110, 6,564,019 and 7,536,133 have disclosed hinged duplexing units for electrostatic printers such as laser printers. Due to the configuration of such printers the duplexing unit was not located near a base of the unit. The hinges of the duplexing units as disclosed in these patents were configured to be horizontal (i.e. parallel to the base), so that the duplexing unit is configured to pivot upward or downward.

In a low-cost desktop printer, such as an inkjet printer, the printer is intended to sit on the user's desk or other flat surface that extends beyond the base of the printer. In addition, for a compact height printer having a C-shaped paper path (with the media input holder located below the media output holder), the duplexing unit is typically located very close to the base of the printer. For a duplexing unit located very close to the base of a desktop printer, a horizontal hinge configuration has disadvantages. If the hinge is located at the top of the duplexing unit, the duplexing unit would pivot upwards. However, since the user is typically taller than the desktop, the upwardly pivoted duplexing unit would obscure visibility and interfere with access to the media paths inside. Even if the user bent over so that his eyes were at desktop level, it would make it difficult to reach in and clear out paper jams between the upwardly pivoted duplexing unit and the desktop. If the hinge is located at the bottom of the duplexing unit, the duplexing unit would pivot downwards. However, if the duplexing unit is located very near the base of the printing apparatus, its pivoting motion would typically cause it to hit the desktop before opening all the way, again interfering with visibility and access to the media paths for clearing paper jams.

What is needed is a duplexing unit that does not require user installation, and that allows good visibility and access to media paths inside the printing apparatus in order to facilitate clearing out paper jams.

SUMMARY OF THE INVENTION

A preferred embodiment of the present invention includes a printing apparatus comprising a base, a wall, or housing, extending at an angle from the base, a print region for printing on media, a media input holder, a media advance system for advancing media from the media input holder to the print region for printing on a first side of a sheet of media, and a pivotable duplexing unit comprising a duplexing media path for reversing the sheet of media in order to print on a second side of the sheet. The pivotable duplexing unit is attached to the wall using a hinge having an axis that is substantially perpendicular to the base. A latch and catch holds the pivotable duplexing unit in a closed position relative to the wall of the printing apparatus. The wall includes a support member for the hinge, and the pivotable duplexing unit further includes a pin for pivoting in a support member of the hinge. The support member includes a bearing surface that is substantially parallel to the base. The pin member includes an end that makes pivotable contact with the bearing surface. A first end of the pivotable duplexing unit includes a projection for latching it in a closed position. A second end includes the pin of the hinge and a spring member for biasing the projection into a corresponding hole when in the closed position. The pin member has a D shape wherein a round portion of the D shape is in contact with a face of the support member of the hinge when the pivotable duplexing unit is latched in the closed position. The round portion of the D shape is not in contact with the face of the support member of the hinge when in an unlatched open position. A screw secures the pin into the support member of the hinge. The media input holder is substantially parallel to the base and located at a first plane proximate to the base. The print region is also substantially parallel to the base. The paper advance system includes a pick roller that is driven to advance a sheet of media from the media input holder. A turn roller further advances the sheet of media received from the pick roller. A feed roller further advances the sheet of media to the print region for printing on the first side. A media end sensor disposed between the turn roller and the feed roller detects front and back edges of a sheet of media.

A duplexing media path support member faces the pivotable duplexing unit when the pivotable duplexing unit is in a closed position. The pivotable duplexing unit includes an inner guide member adjacent the duplexing media support member when the pivotable duplexing unit is in a closed position. An inner cover member disposed adjacent the inner guide member. An outer cover member is disposed adjacent the inner cover member. The inner guide member includes a surface having a first curvature, e.g. convex, proximate the base and a second curvature, e.g. concave, distal to the base, the second curvature having an opposite sense relative to the first curvature. The inner guide member includes a pinch roller for holding a sheet of media against the turn roller. The pinch roller is placed near a portion of the surface having the second curvature. A second latch affixes the inner guide member to the inner cover member. The pivotable duplexing unit also includes a third latch to affix the inner cover member to the outer cover member. The inner and outer cover members include a curved surface, wherein the curved surface of the inner cover member faces and is spaced apart from the curved surface of the outer cover member. The pivotable duplexing unit does not include any rollers used to advance the sheet of media through the duplexing path. The pivotable duplexing unit includes a duplexing advance roller that is driven by a friction wheel that contacts a pinch roller and the duplexing advance roller. The outer cover comprises a pin that is part of the hinge.

The inner guide member comprises a projection for latching the pivotable duplexing unit in a closed position relative to the wall of the printing apparatus. A spring member biases the projection into a corresponding hole when the pivotable duplexing unit is in the closed position. The pivotable duplexing unit is located proximate to the base, while a scanning apparatus is located distal to the base.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. For example, the summary descriptions above are not meant to describe individual separate embodiments whose elements are not interchangeable. In fact, many of the elements described as related to a particular embodiment can be used together with, and possibly interchanged with, elements of other described embodiments. Many changes and modifications may be made within the scope of the present invention without departing from the spirit thereof, and the invention includes all such modifications. The figures below are intended to be drawn neither to any precise scale with respect to relative size, angular relationship, or relative position nor to any combinational relationship with respect to interchangeability, substitution, or representation of an actual implementation.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
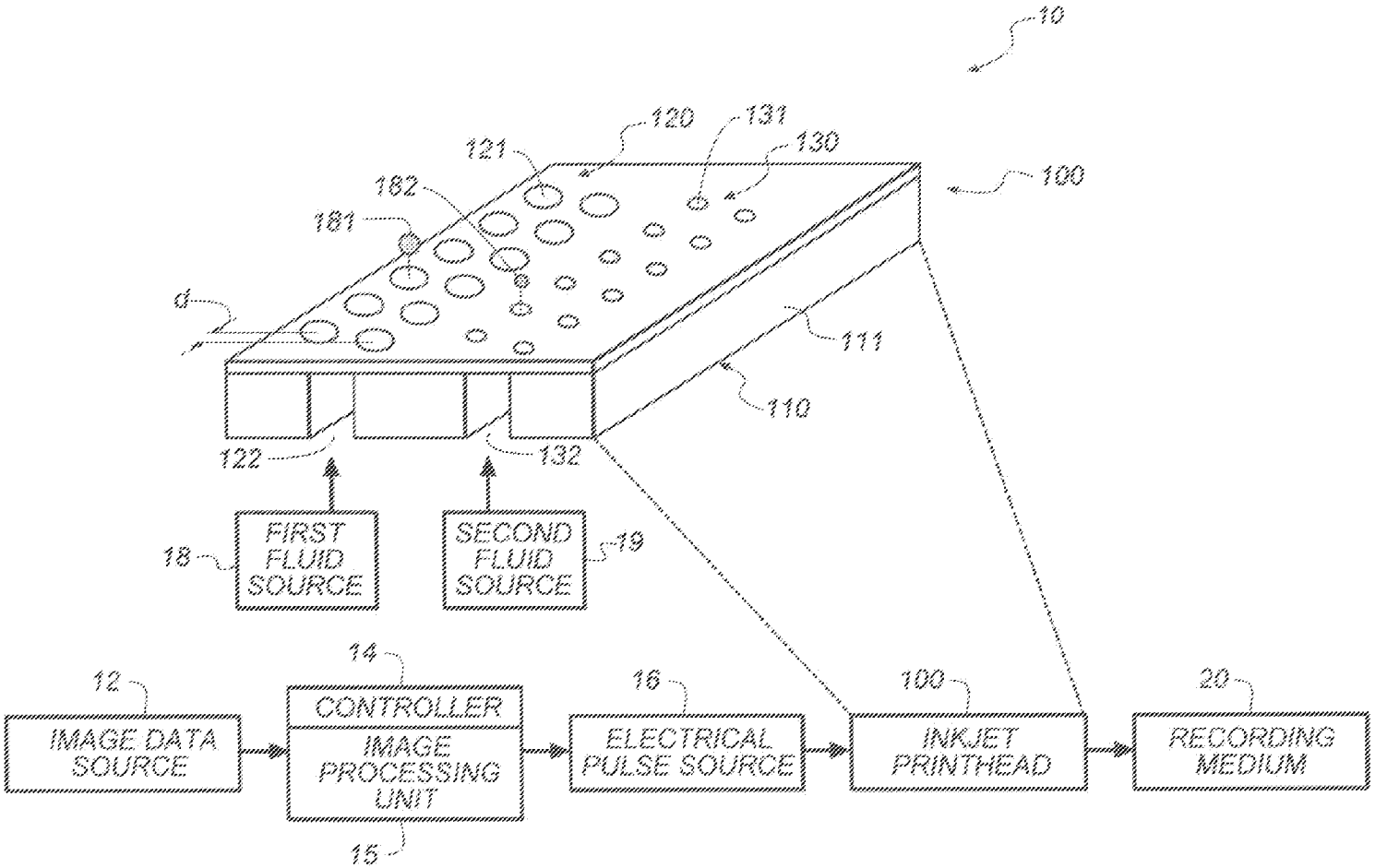
FIG. 1 is a schematic representation of an inkjet printer system.

Referring to FIG. 1, a schematic representation of an inkjet printer system 10 is shown, for its usefulness with preferred embodiments of the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. $d=1/1200$ inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a hi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
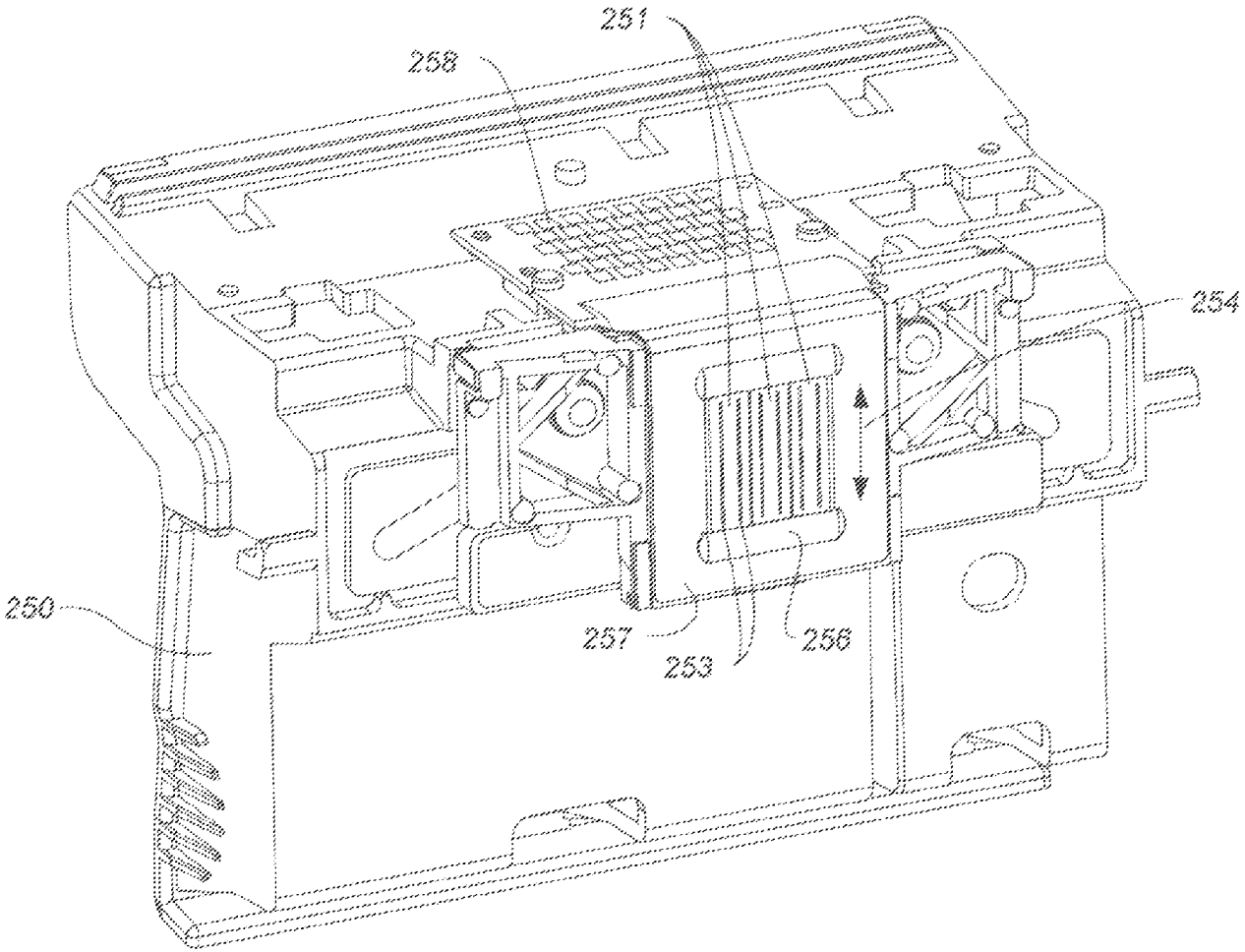
FIG. 2 is a perspective view of a portion of a printhead chassis.

FIG. 2 shows a perspective view of a portion of a printhead chassis 250, which is an example of an inkjet printhead 100. Printhead chassis 250 includes three printhead die 251 (similar to printhead die 110 in FIG. 1), each printhead die 251 containing two nozzle arrays 253, so that printhead chassis 250 contains six nozzle arrays 253 altogether. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead chassis 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals can be transmitted to the printhead die 251.

Figure 3:
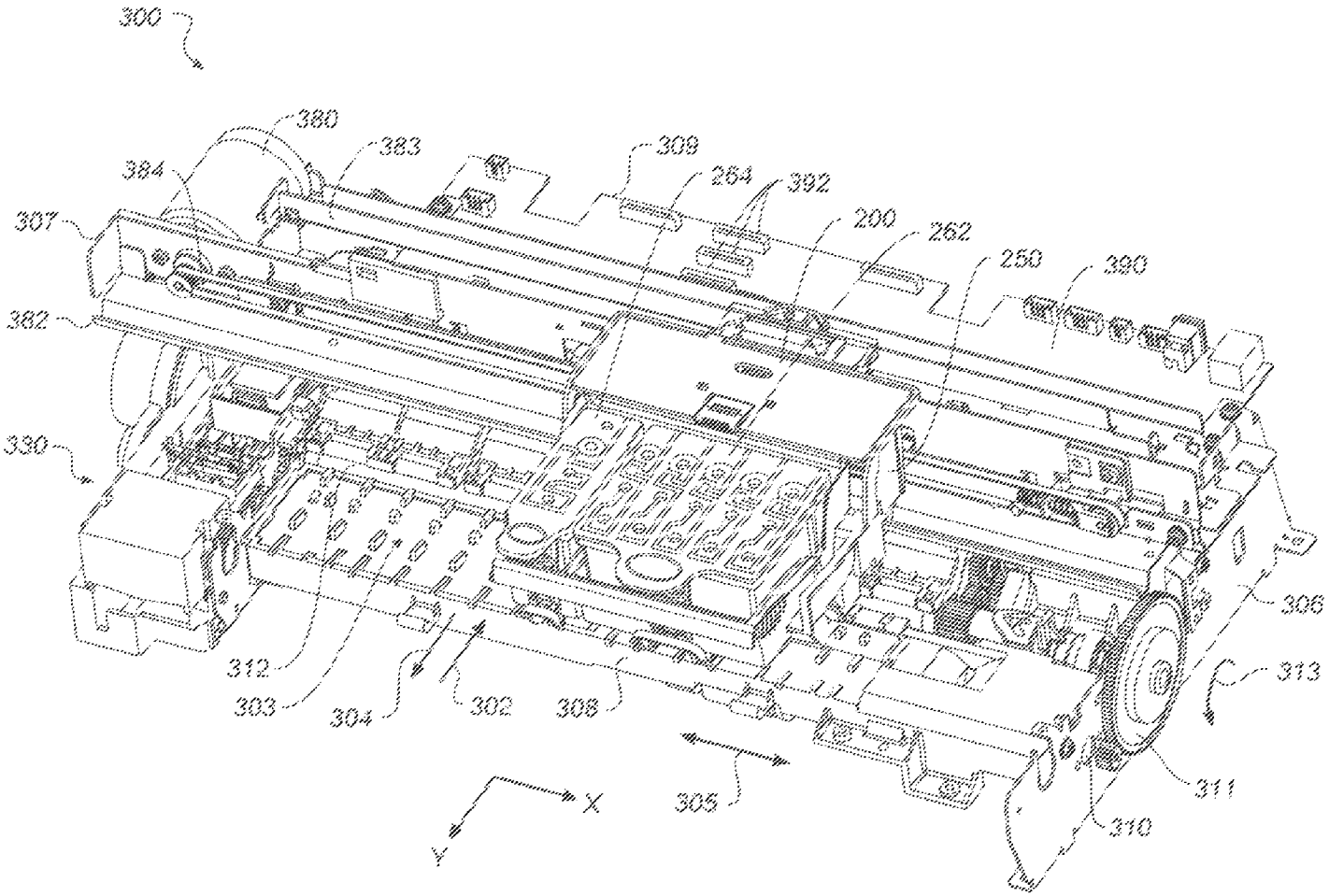
FIG. 3 is a perspective view of a portion of a desktop carriage printer.

FIG. 3 shows a portion of a desktop carriage printer. Some of the parts of the printer have been hidden in the view shown in FIG. 3 so that other parts can be more clearly seen. Printing apparatus 300 has a print region 303 across which carriage 200 is moved back and forth in carriage scan direction 305 along the X axis, between the right side 306 and the left side 307 of printing apparatus 300, while drops are ejected from printhead die 251 (not shown in FIG. 3) on printhead chassis 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead chassis 250 is mounted in carriage 200, and multi-chamber ink tank 262 and single-chamber ink tank 264 are mounted in the printhead chassis 250. The mounting orientation of printhead chassis 250 is rotated relative to the view in FIG. 2, so that the printhead die 251 are located at the bottom side of printhead chassis 250, the droplets of ink being ejected downward onto the recording medium in print region 303 in the view of FIG. 3. Multi-chamber ink tank 262, in this example, contains five ink sources: cyan, magenta, yellow, photo black, and colorless protective fluid; while single-chamber ink tank 264 contains the ink source for text black. Paper or other recording medium (sometimes generically referred to as paper or media herein) is loaded along paper load entry direction 302 toward the front of printing apparatus 308.

The motor that powers the media advance rollers is not shown in FIG. 3, but the hole 310 at the right side of the printing apparatus 306 is where the motor gear (not shown) protrudes through in order to engage feed roller gear 311, as well as the gear for the discharge roller (not shown). A forward direction of rotation 313 is indicated. Toward the rear of the printing apparatus 309 is located the electronics board 390, which includes cable connectors 392 for communicating via cables (not shown) to the printhead carriage 200 and from there to the printhead chassis 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Figure 4:
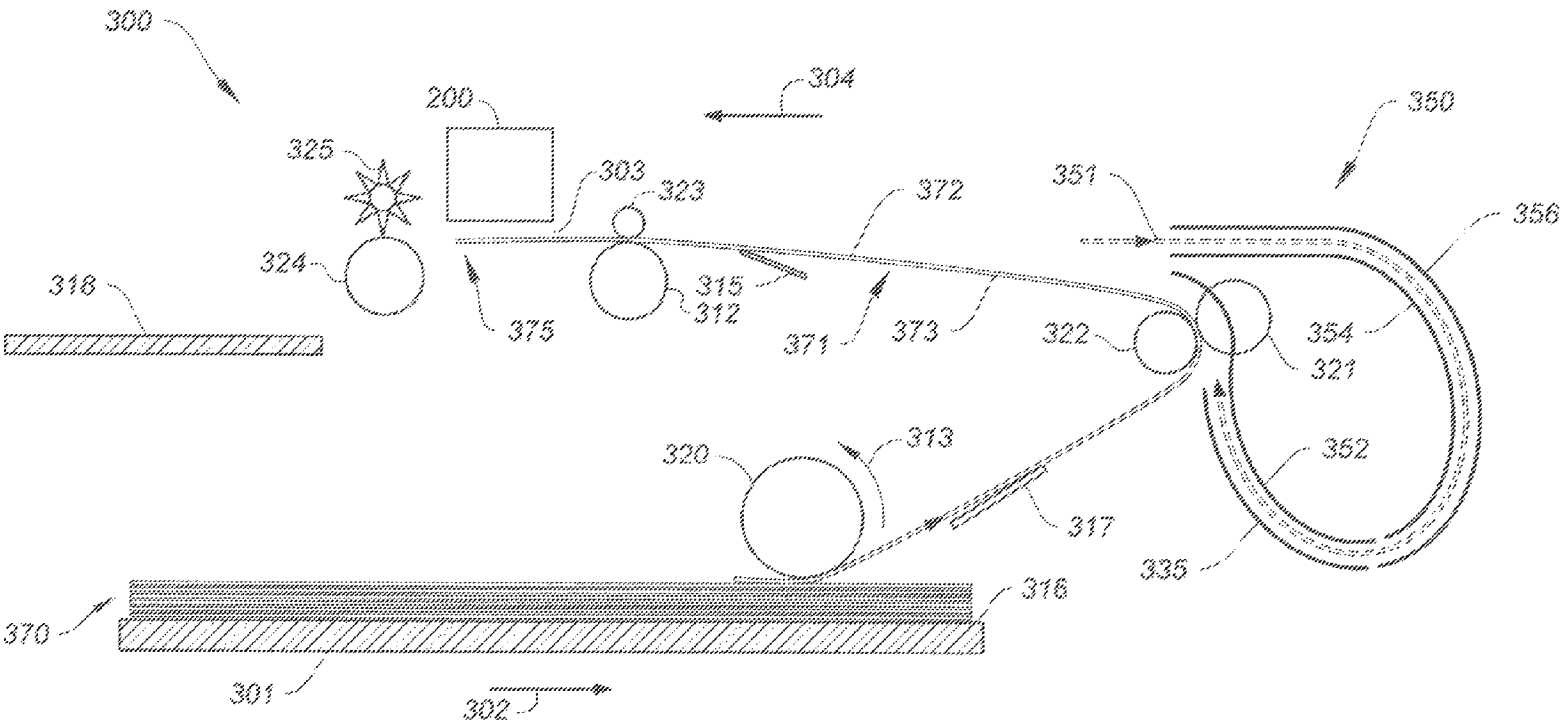
FIG. 4 is a schematic side view of an exemplary media path in a carriage printer that includes a duplexing unit.

The media advance system includes a variety of rollers that are used to advance the medium through the printer as shown schematically in the side view of FIG. 4. In this example, a media input holder 316, which is located at a plane near the base 301 and is substantially parallel to base 301, holds a stack of media 370. A pick roller 320 is driven to rotate in forward rotation direction 313 to advance the top sheet 371 of the stack of media 370 from media input holder 316 along paper load entry direction 302 and up inclined guide 317. A turn roller 322 is driven to further advance the sheet of media 371 received from the pick roller around a C-shaped path (in cooperation with a curved rear wall surface and a pinch roller 321). As a result, the sheet 371 continues to advance along media advance direction 304 from the rear 309 of the printing apparatus (with reference also to FIG. 3) toward the print region 303 that is located at a plane that is farther from base 301 than the media input holder 316 is. The sheet 371 is then advanced by feed roller 312 (driven to rotate in forward rotation direction 313) and idler roller(s) 323 to advance the lead edge 375 of sheet 371 to and across print region 303 for printing on first side 372 of sheet 371, and from there to a discharge roller 324 and star wheel(s) 325. If the printing is to occur only on first side 372, discharge roller 324 is driven in forward rotation direction 313 to continue to advance sheet 371 along media advance direction 304 until sheet 371 exits into optional media output holder 318, a portion of which is shown in FIG. 4. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller. A media end sensor 315 is positioned near feed roller 312 between turn roller 322 and feed roller 312 in order to detect when a sheet of media is approaching the feed roller 312. In FIG. 4, the sheet 371 has pushed the media end sensor 315 down.

Also schematically shown in FIG. 4 is a duplexing unit 350 that includes a duplexing media path 351 for reversing the sheet 371 of media in order to print on a second side 373 of the sheet that is opposite first side 372. As will be described in further detail below, in preferred embodiments of the present invention duplexing unit 350 is pivotably mounted in order to provide accessibility for clearing paper jams. In the preferred embodiments described below, a duplexing media path support member 335 is configured to face the pivotable duplexing unit 350 when the pivotable duplexing unit 350 is in a closed position. The portion of the duplexing media path 351 that is included in the pivotable duplexing unit 350 includes an inner guide member 352 that is adjacent the duplexing media support member 335 when the pivotable duplexing unit 350 is in a closed position; an inner cover member 354 that is adjacent the inner guide member 352; and an outer cover member 356 that is adjacent the inner cover member 354. As can be seen in FIG. 4, the surface of inner guide member 352 has a first curvature near base 301, and a second curvature farther from base 301, where the second curvature has an opposite sense from the first curvature, so that the surface of inner guide member 352 is somewhat an inverted S-shape (or S-shaped as seen from the opposite perspective from the view shown in FIG. 4). In addition, inner cover member 354 includes a curved surface and outer cover member 356 includes a curved surface, such that the curved surface of inner cover member 354 faces and is spaced apart from the curved surface of outer cover member 356.

Figure 5:
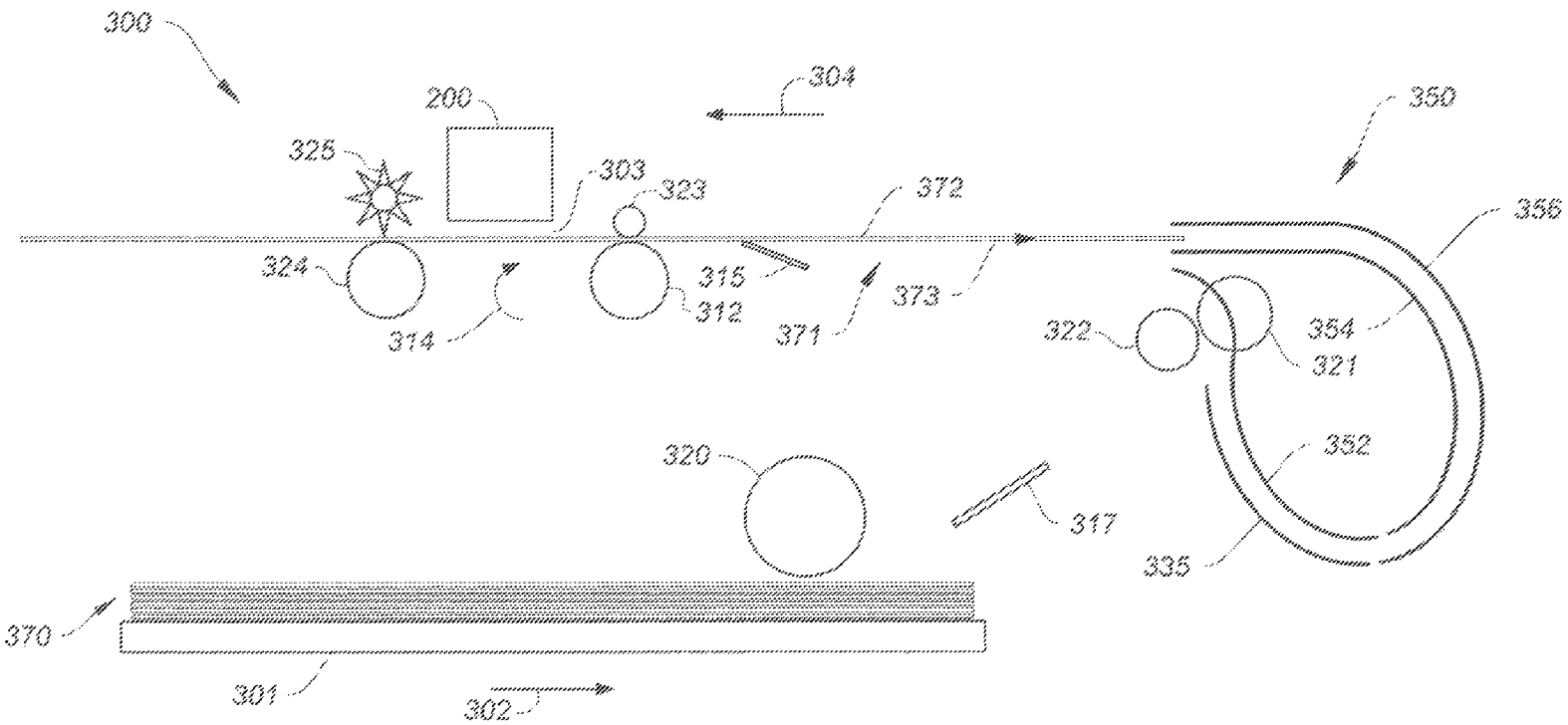
FIG. 5 is a schematic side view of the media path of FIG. 4, where one side of the sheet has been printed and the sheet is travelling toward the duplexing unit.
Figure 6:
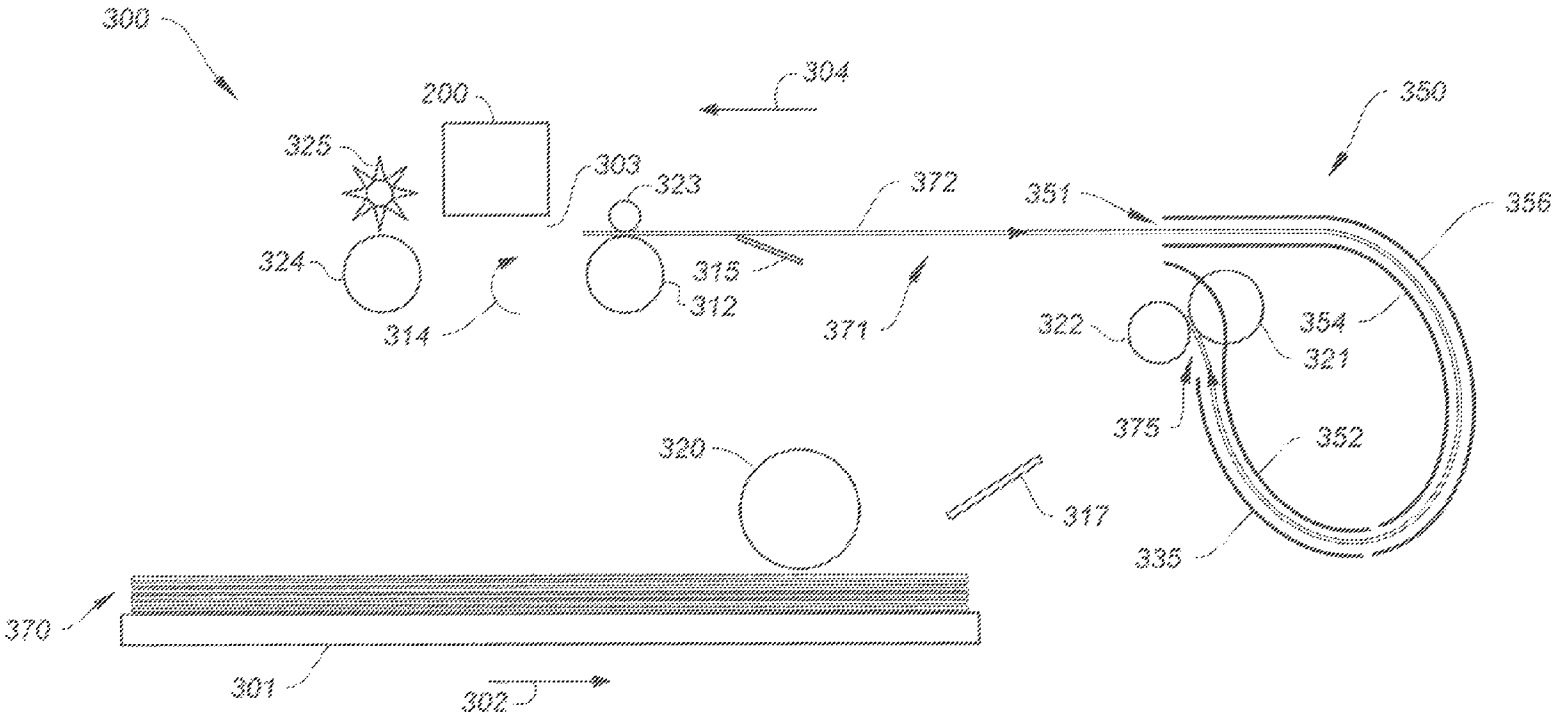
FIG. 6 is a schematic side view of the media path of FIG. 4, where one side of the sheet has been printed and the sheet is travelling through the duplexing unit to orient the opposite side of the sheet toward the print region.
Figure 7:
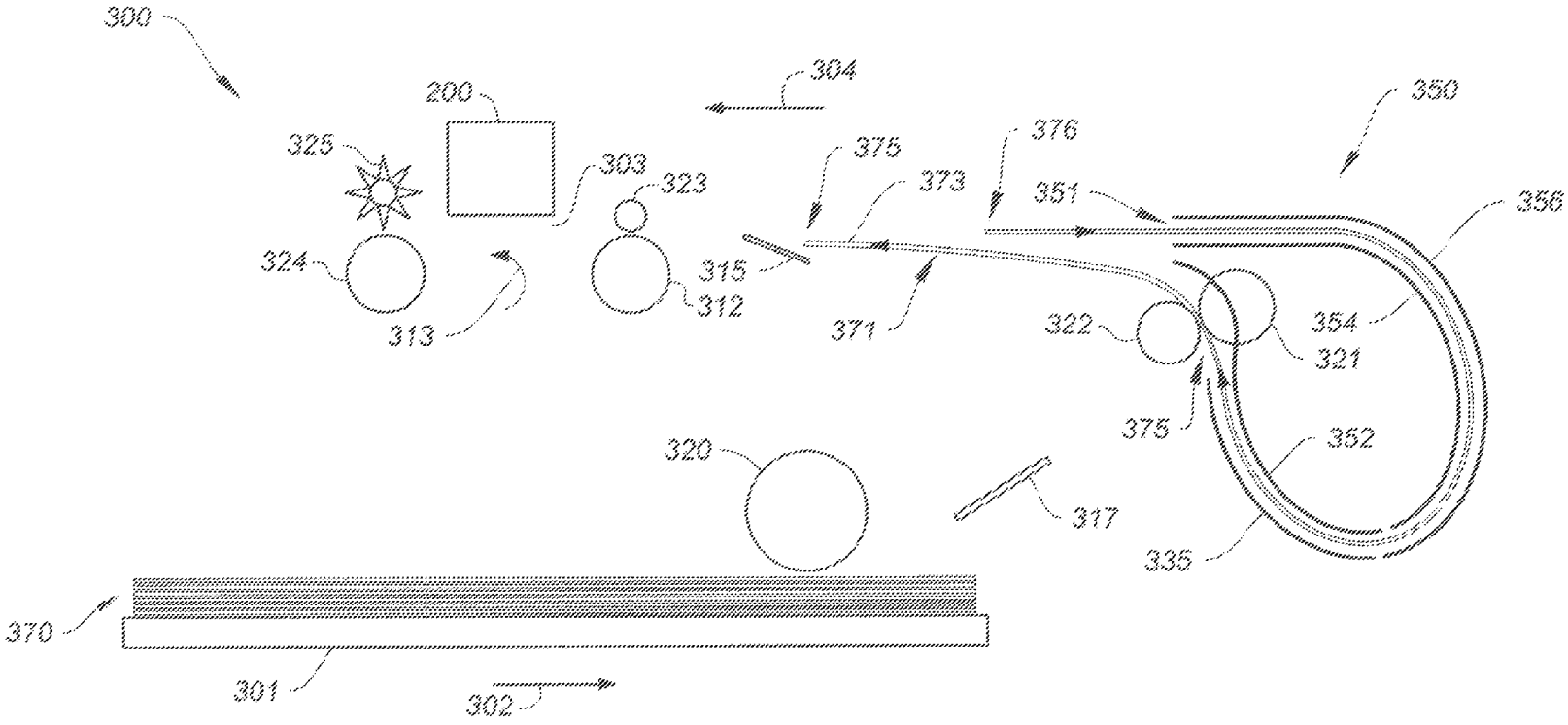
FIG. 7 is a schematic side view of the media path of FIG. 4, where the lead edge of the sheet has exited the duplexing unit and is approaching the print region.

FIGS. 5 to 7 show a sequence of positions of a sheet 371 of media as it approaches the duplexing unit 350 (FIG. 5), travels through duplexing unit 350 until the end of sheet 371 reaches turn roller 322 (FIG. 6), and is advanced by turn roller 322 toward feed roller 312 with second side 373 of sheet 371 now facing the print region 303 (FIG. 7). In FIG. 5, feed roller 312 and discharge roller 324 are driven to rotate in reverse rotation direction 314 to move sheet 371 toward duplexing unit 350. Media end sensor 315 continues to be pushed down by sheet 371.

In FIG. 6 sheet 371 is still being moved by feed roller 312 (rotating in reverse rotation direction 314) through duplexing unit 350, and the lead edge 375 of sheet 371 has just reached turn roller 322. In preferred embodiments such as shown in FIG. 6 and similar to the passive duplex unit described in U.S. Pat. No. 7,561,823, if the media path from the feed roller 312 through duplexing media path 351 and to turn roller 322 is sufficiently short relative to the length of the media, then no drive rollers are required in duplexing unit 350. This is advantageous because no gears are required to provide power to a powered roller within duplexing unit 350. In addition to saving cost and complexity, having no gears in the duplexing unit 350 that are required to mesh with gears in the main body of the printing apparatus makes it easier to close the pivotable duplexing unit 350 after it has been opened. In some preferred embodiments the media path from the feed roller 312 through duplexing media path 351 and to turn roller 322 is designed to be slightly shorter than 11 inches, so that both letter sized paper and A4 sized paper can be advanced through a duplexing unit 350 having no powered rollers within the duplexing unit.

In FIG. 7 lead edge 375 of sheet 371 has moved all the way through the duplexing media path 351 and is being advanced by turn roller 322 toward feed roller 312. Since lead edge 375 has not yet reached media end sensor 315, and trail edge 376 has been advanced past media edge sensor 315, media edge sensor 315 is not pushed down by sheet 371 in FIG. 7. Having a single media edge sensor 315 provides an additional constraint on the length of a sheet of media that is compatible with duplexing unit 350. In particular, the length of the sheet needs to be short enough that both lead edge 375 and trail edge 376 of sheet 371 cannot push media edge sensor 315 down at the same time. Otherwise the position of the sheet would be indeterminate, and the controller would not be able to determine when to change the direction of rotation of feed roller 312 from reverse rotation direction 314 to forward rotation direction 313 in order to advance lead edge 375 of sheet 371 to print region 303 in order to print second side 373.

Figure 8:
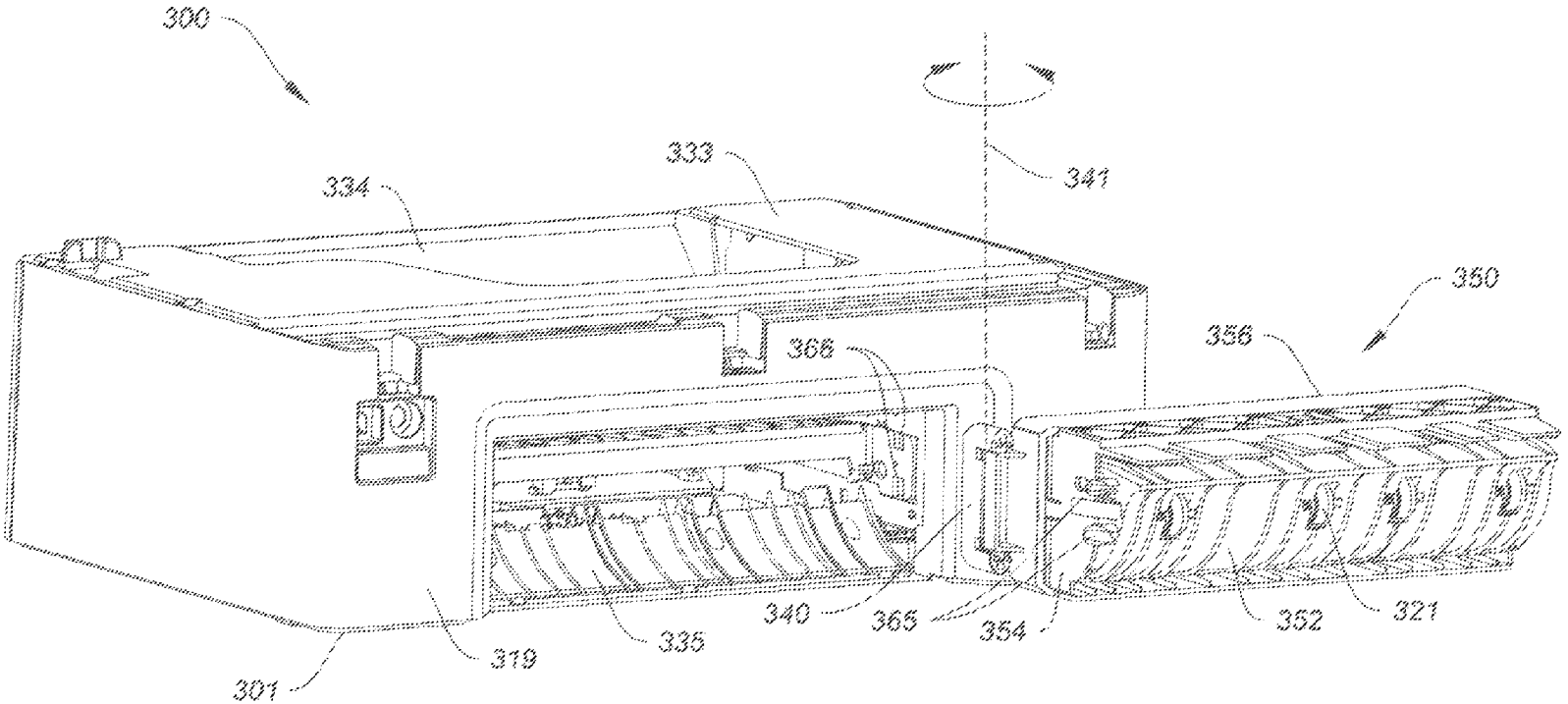
FIG. 8 is a perspective view of a printing apparatus with a pivotable duplexing unit according to a preferred embodiment of the invention.

FIG. 8 is a perspective view of printing apparatus 300 with a pivotable duplexing unit 350 in its open position according to a preferred embodiment of the invention. With reference to FIG. 3, FIG. 8 also includes covers over the printer chassis framework, and the perspective is from the rear 309 of the printing apparatus. Printing apparatus 300 includes a base 301 to support the printing apparatus during operation. A wall 319 extends at an angle from base 301. In the example of FIG. 8, wall 319 is substantially perpendicular to base 301. Pivotable duplexing unit 350 is attached to wall 319 using a hinge 340 having an axis 341 that is substantially perpendicular to base 301. Duplexing unit 350 is pivotable about axis 341 in the directions indicated by the double headed curved arrow. Since the base 301 of printing apparatus 300 is substantially horizontal during operation, the axis 341 of hinge 340 is substantially vertical, unlike the horizontal hinges of the hinged duplexing units disclosed in U.S. Pat. Nos. 4,825,245, 4,884,110, 6,564,019 and 7,536,133 that were cited in the background. Thus, rather than pivoting upward or downward relative to the base 301, pivotable duplexing unit 350 swings outward, sweeping out a path that is parallel to base 301. Therefore pivotable duplexing unit 350 can be opened fully without interfering with the surface upon which base 301 rests, even though it is located close to the base 301. Opening the pivotable duplexing unit 350 outward also does not result in the duplexing unit 350 obscuring visibility of media paths inside printing apparatus 300. Thus the configuration of hinge 340 with its axis 341 perpendicular to base 301 is advantageous, especially for desktop printers having the duplexing unit located close to the base 301.

Figure 9:
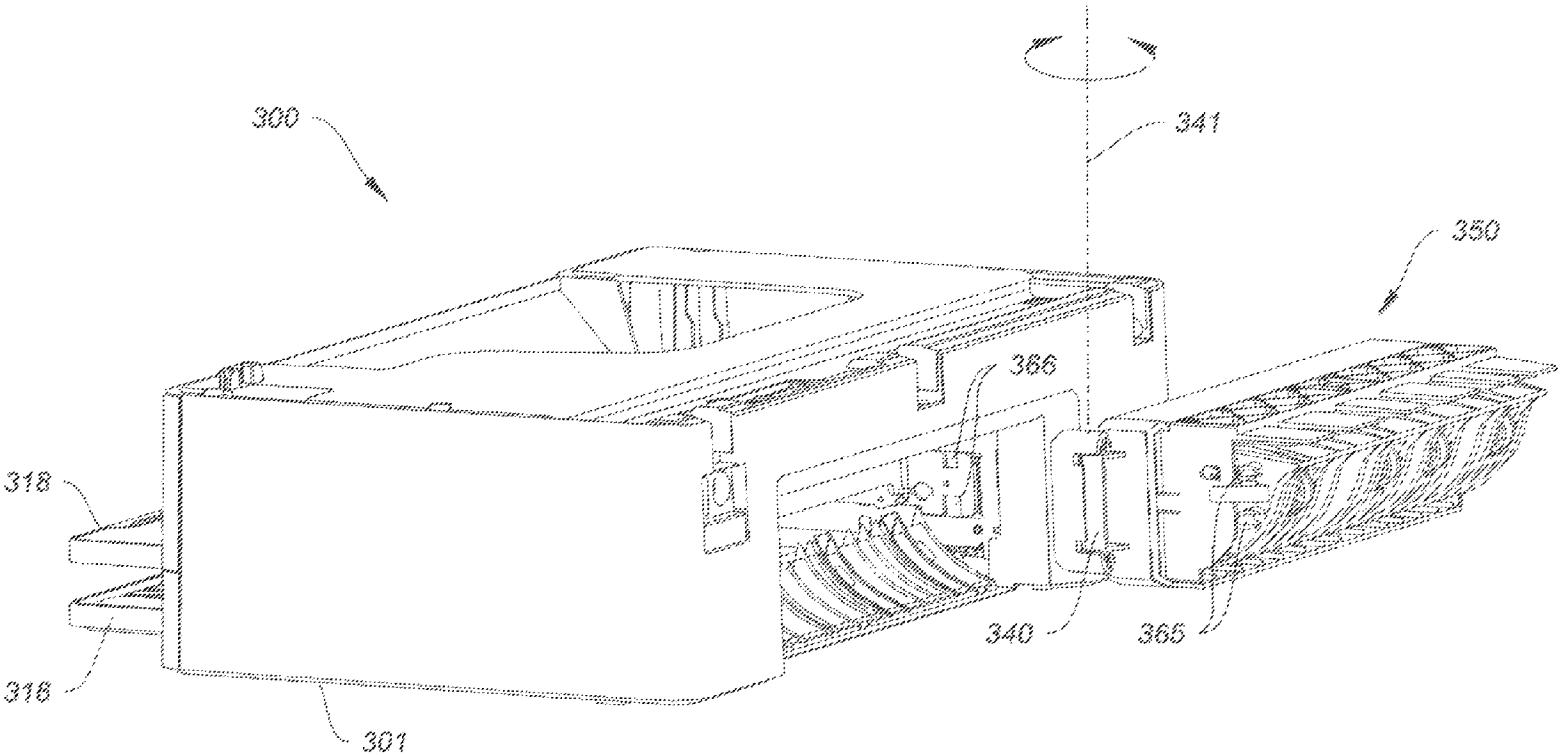
FIG. 9 is a rotated perspective view of the printing apparatus of FIG. 8.
Figure 10:
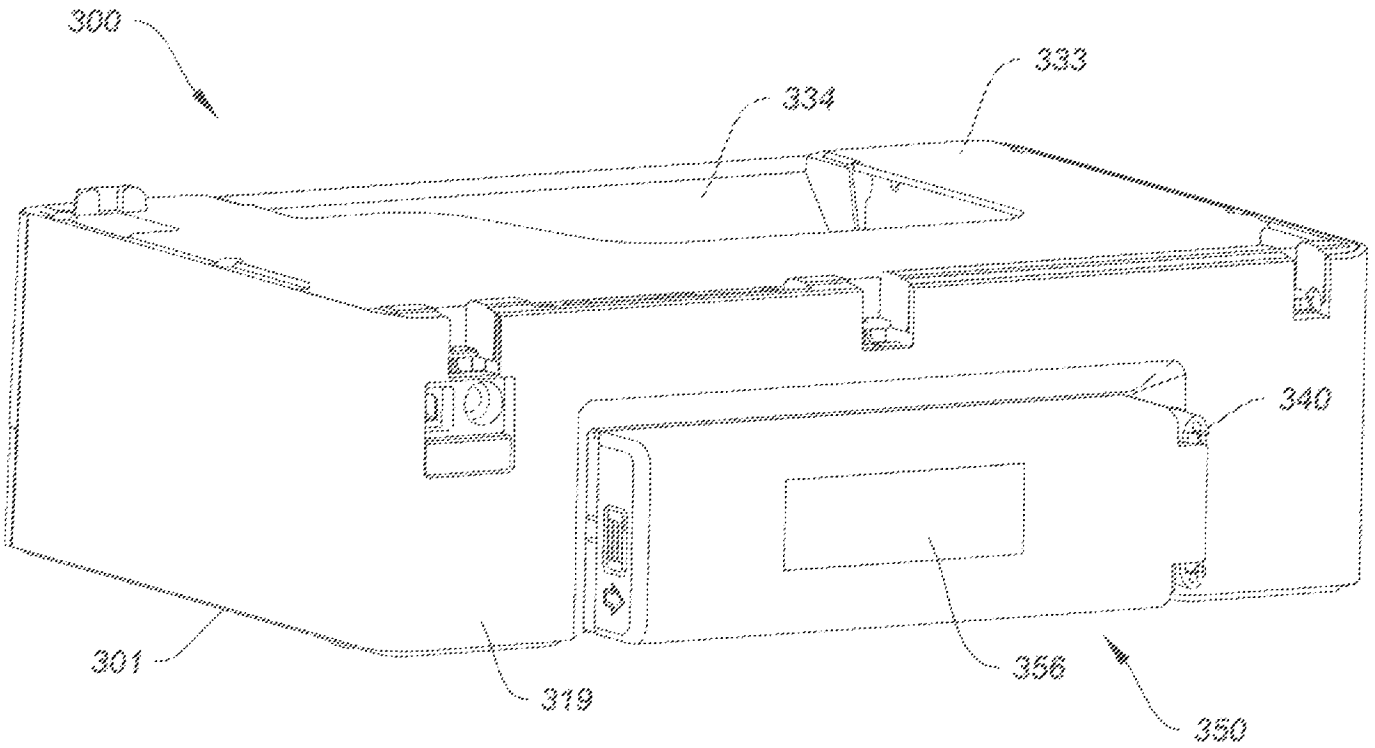
FIG. 10 is a perspective view of the printing apparatus of FIG. 8 with the pivotable duplexing unit in a closed position.

FIG. 8 shows part of the securing mechanism for holding pivotable duplexing unit 350 in its closed position as it is in FIG. 10. Located at the same end of pivotable duplexing unit 350 as hinge 340 are pegs 365. When pivotable duplexing unit 350 is closed, pegs 365 enters holes 366 within the main body of printing apparatus 300. FIG. 9 is a view that is rotated relative to FIG. 8 in order to show media input holder 316 and media output holder 318. Pegs 365 and holes 366 are seen from a different perspective in FIG. 9. There is a peg (unlabeled, see FIG. 14) just above the labeled peg 365 and a hole (unlabeled, see FIG. 11) just above the labeled hole 366 and corresponding to the unlabeled peg.

Also shown in FIG. 8 are items shown schematically in FIGS. 4-7, including duplexing media support member 335, inner guide member 352, inner cover member 354, outer cover member 356 and pinch rollers 321. Curved surfaces of duplexing media support member 335 and inner guide member 352 are shown as being ribbed, in order to reduce friction against media being advanced through duplexing unit 350. Not shown in FIG. 8 are the curved surfaces of inner cover member 354 or outer cover member 356, or turn rollers 322. Turn rollers 322 would line up with pinch rollers 321 when pivotable duplexing unit 350 is in a closed position, as it is in FIG. 10. Similarly, when pivotable duplexing unit is in a closed position, duplexing media support member 335 faces pivotable duplexing unit 350. Like the auxiliary removable duplex unit disclosed in U.S. Pat. No. 7,561,823, there are no powered rollers in some preferred embodiments of the duplexing unit 350 such as the example of FIG. 8. Unlike the auxiliary removable duplex unit disclosed in U.S. Pat. No. 7,561,823, if the pivotable duplexing unit 350 is in its open position, media advance for one-sided printing will not operate properly, as the media being advanced by the pick roller 320 (FIG. 4) would tend to exit through the open duplexing unit 350 without reaching turn roller 322.

In some multi-function printer embodiments a scanning apparatus (not shown) is assembled on top of the upper surface 333 of the cover of printing apparatus 300, i.e. the scanning apparatus is located farther from the base than pivotable duplexing unit 350 is. When the scanning apparatus is pivoted upward from printing apparatus, the user can change ink tanks 262 and 264 (FIG. 3) by reaching through access opening 334.

Figure 11:
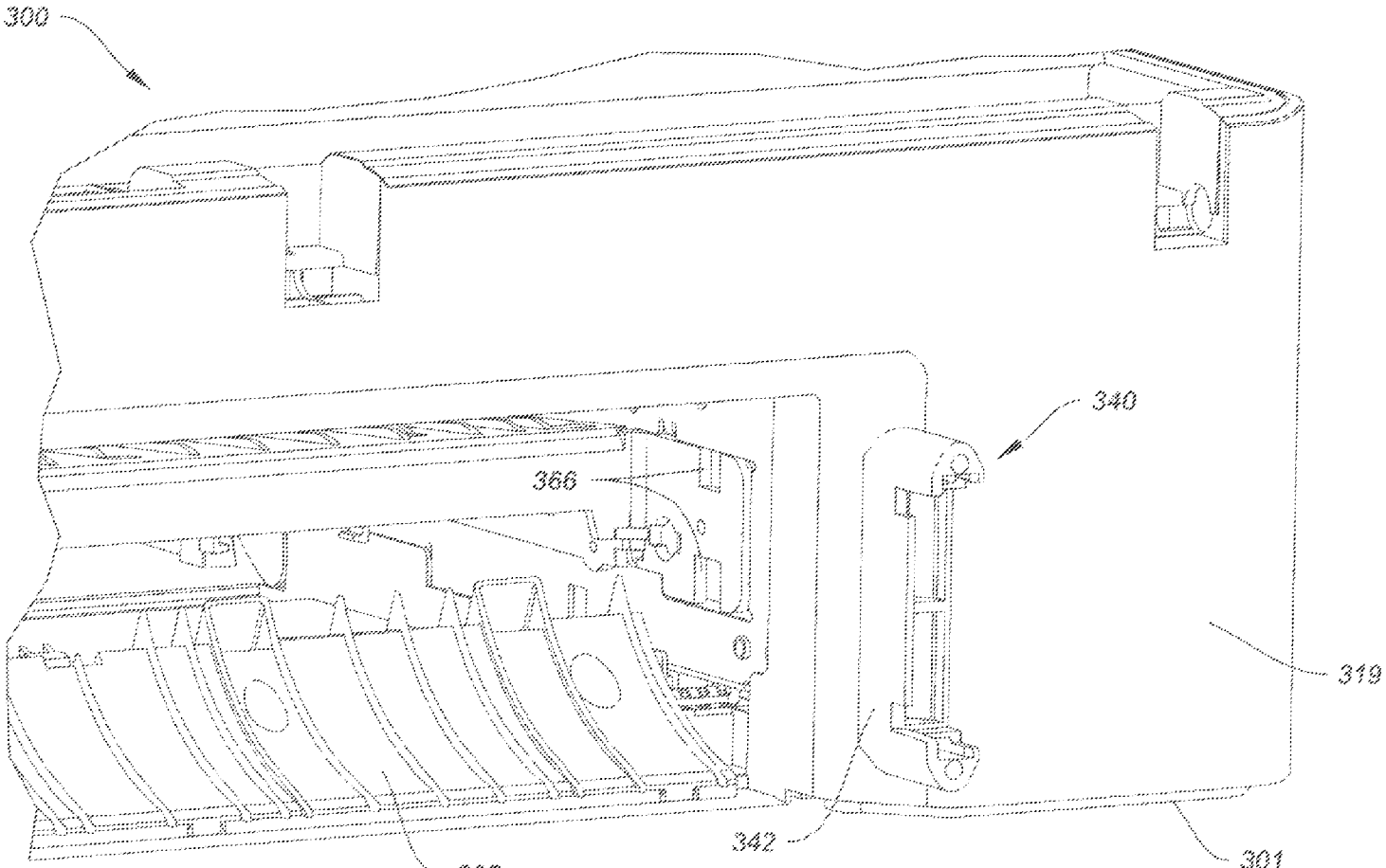
FIGS. 11 and 12 are close-up perspective views of a portion of a hinge for the pivotable duplexing unit of FIG. 8.
Figure 12:
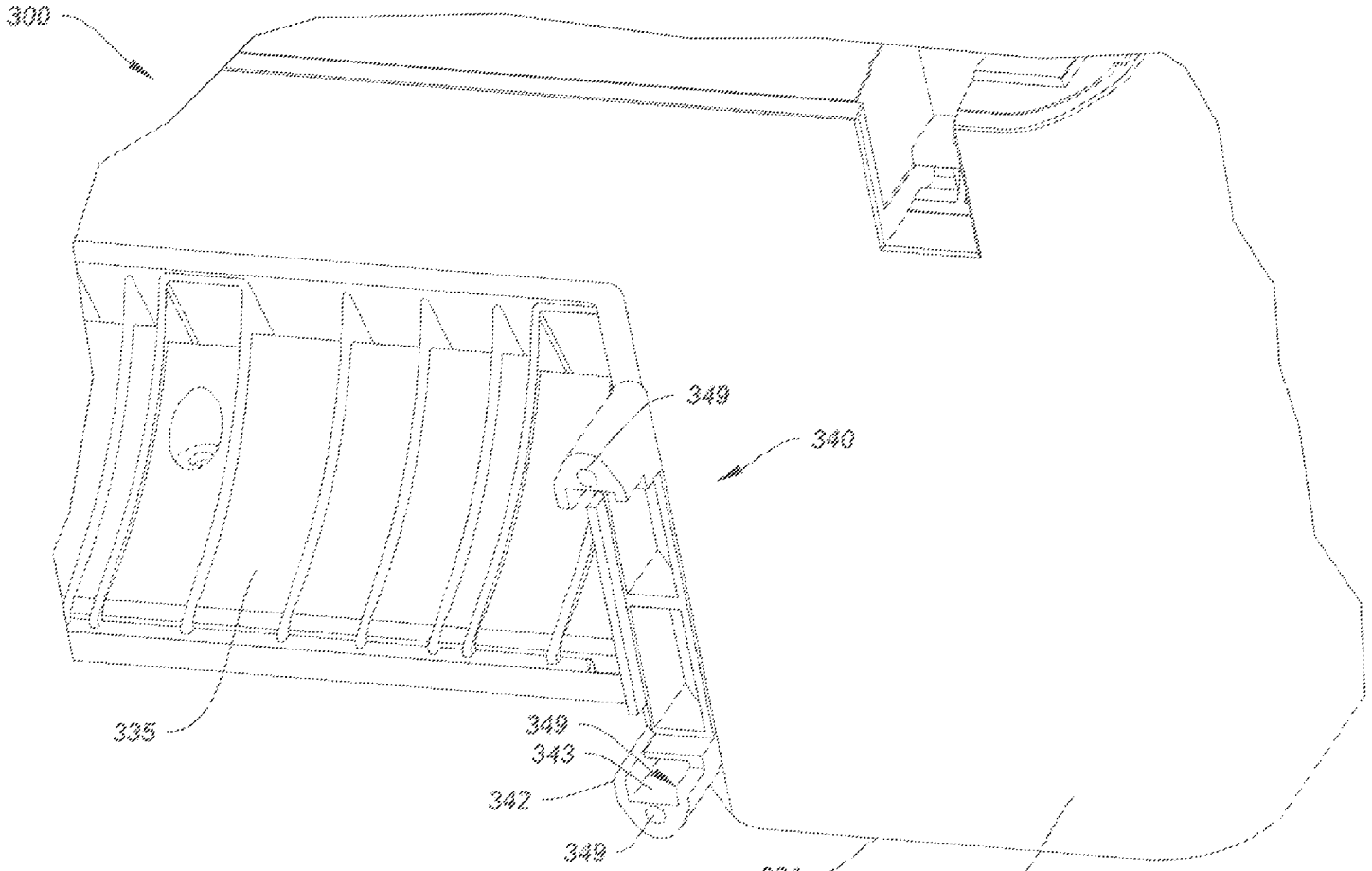
Figure 13:
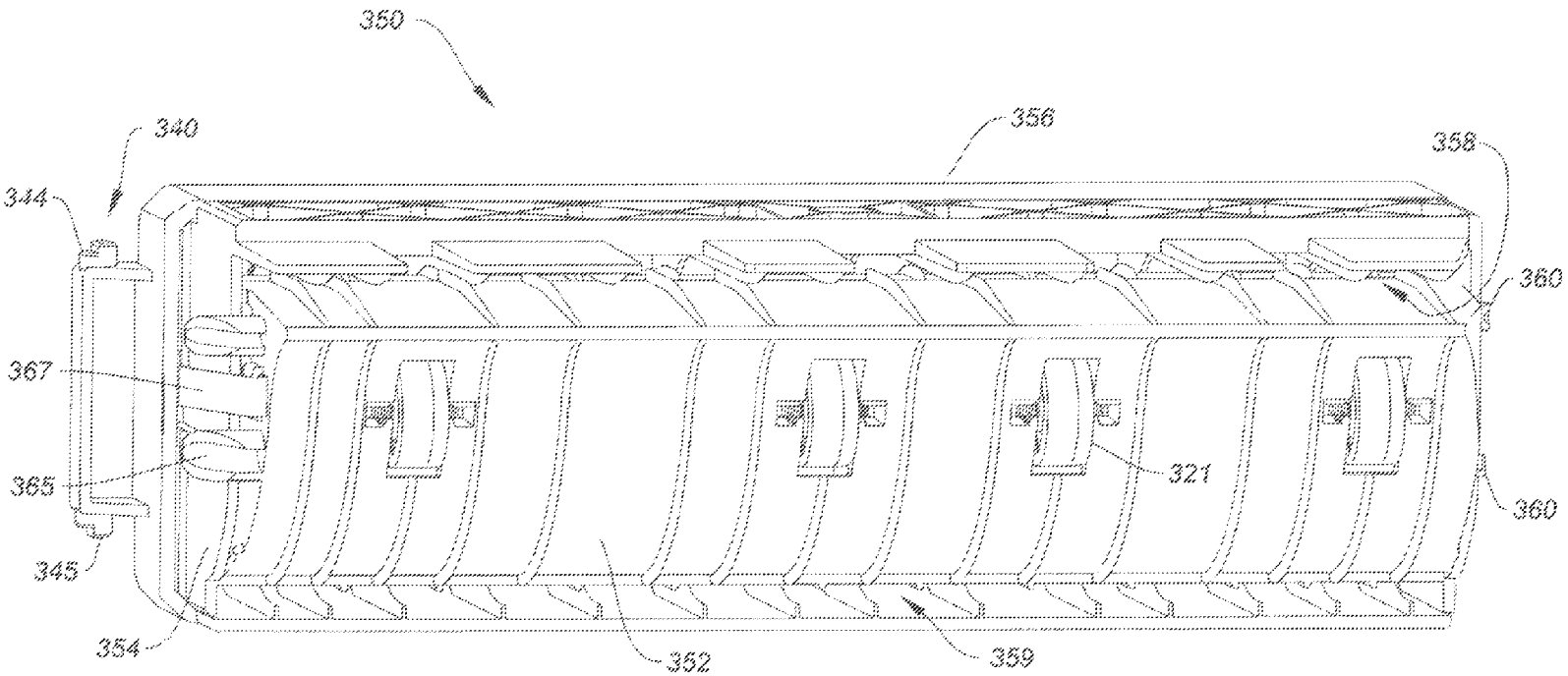
FIGS. 13 and 14 are perspective views of the pivotable duplexing unit of FIG. 8.

FIG. 11 is a close-up perspective view of the portion of printing apparatus 300 that includes the region of the hinge 340, but with the pivotable duplexing unit hidden from view to show some details more clearly. In particular, wall 319 includes a support member 342 of hinge 340. FIG. 12 shows a similar portion of printing apparatus 300, but from a more downward looking perspective than FIG. 11 in order to show the bearing surface 343 of support member 342 of hinge 340 for contacting an end of a pin member 344 (FIG. 13). Also indicated in FIG. 12 is a contact face 348 for contacting a round edge of pin member 344.

FIG. 13 is a perspective view of the pivotable duplexing unit 350, but with printing apparatus 300 hidden from view. Features of pivotable duplexing unit 350 described above relative to FIG. 8 are shown at higher magnification in FIG. 13 for better clarity. Also shown in FIG. 13 are the entry 358 through which sheets of media enter the duplexing unit 350 and the exit 359 from which sheets of media exit the duplexing unit 350. In addition the pin member 344 of hinge 340 is shown. In the assembly view of FIG. 8, pin member 344 is not clearly seen, but with reference also to FIGS. 11 and 12, pin member 344 is for pivoting relative to support member 342 of hinge 340. An end 345 of pin member 344 (FIG. 13) makes pivotable contact with bearing surface 343 of support member 342 of hinge 340 (FIG. 12). Also shown in FIG. 12 are screw holes 349 for screws to secure pin member 344 into support member 342 of hinge 340.

As seen in FIG. 13, pivotable duplexing unit 350 includes a first end including at least one projection 360 for latching the pivotable duplexing unit 350 in a closed position, and a second end opposite the first end, where the second end includes the pin member 344 of the hinge 340 and a spring member 367 for biasing projection(s) 360 into corresponding hole(s) 361 (FIG. 15) when pivotable duplexing unit 350 is in the closed position. The spring member can be attached to the duplexing unit by sliding it into a sleeve formed in the duplexing unit. Thus projection 360 serves as a latch and hole 361 serves as a catch for holding the pivotable duplexing unit in a closed position relative to the wall of the printing apparatus 360.

Figure 14:
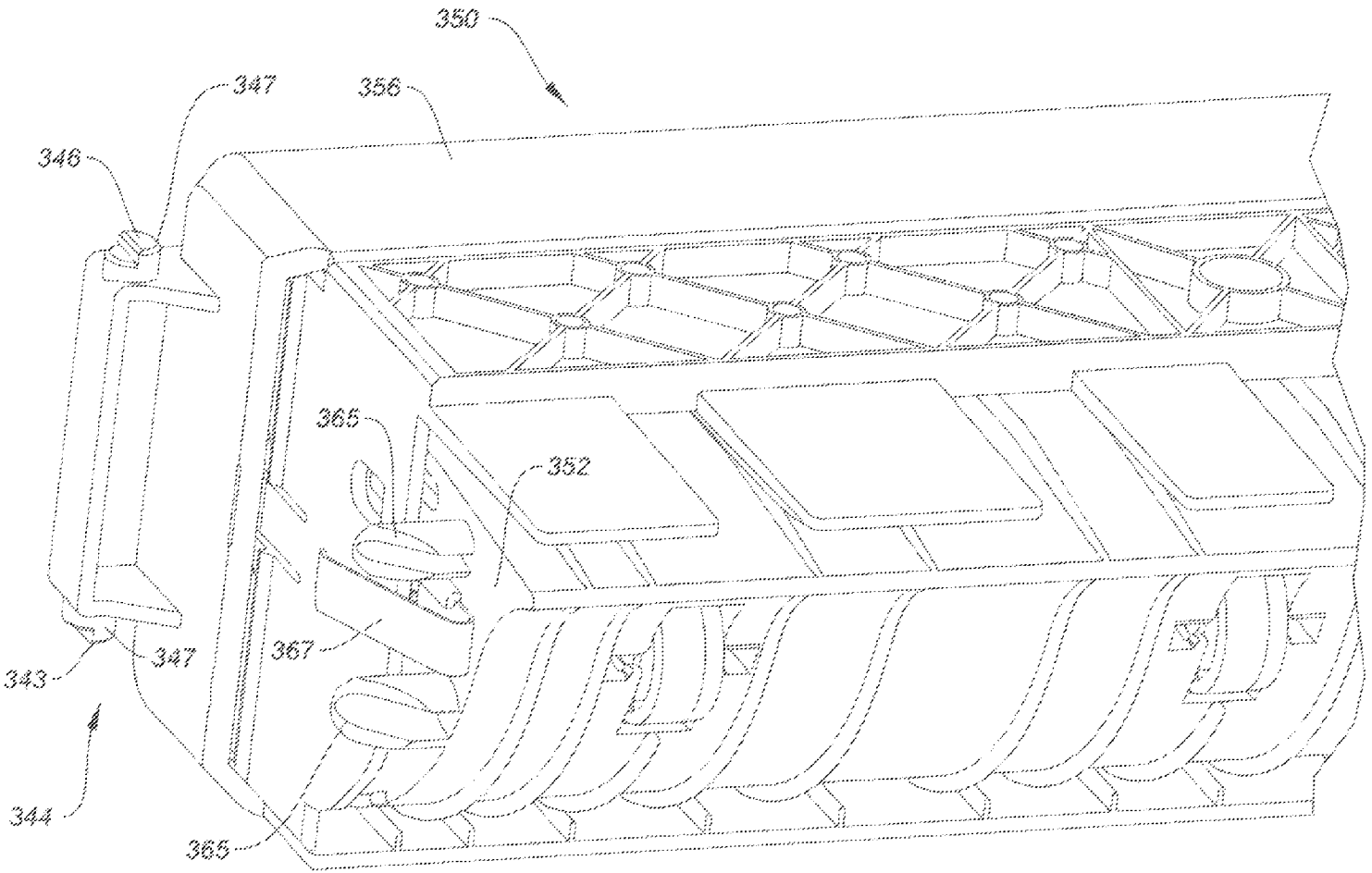
Figure 15:
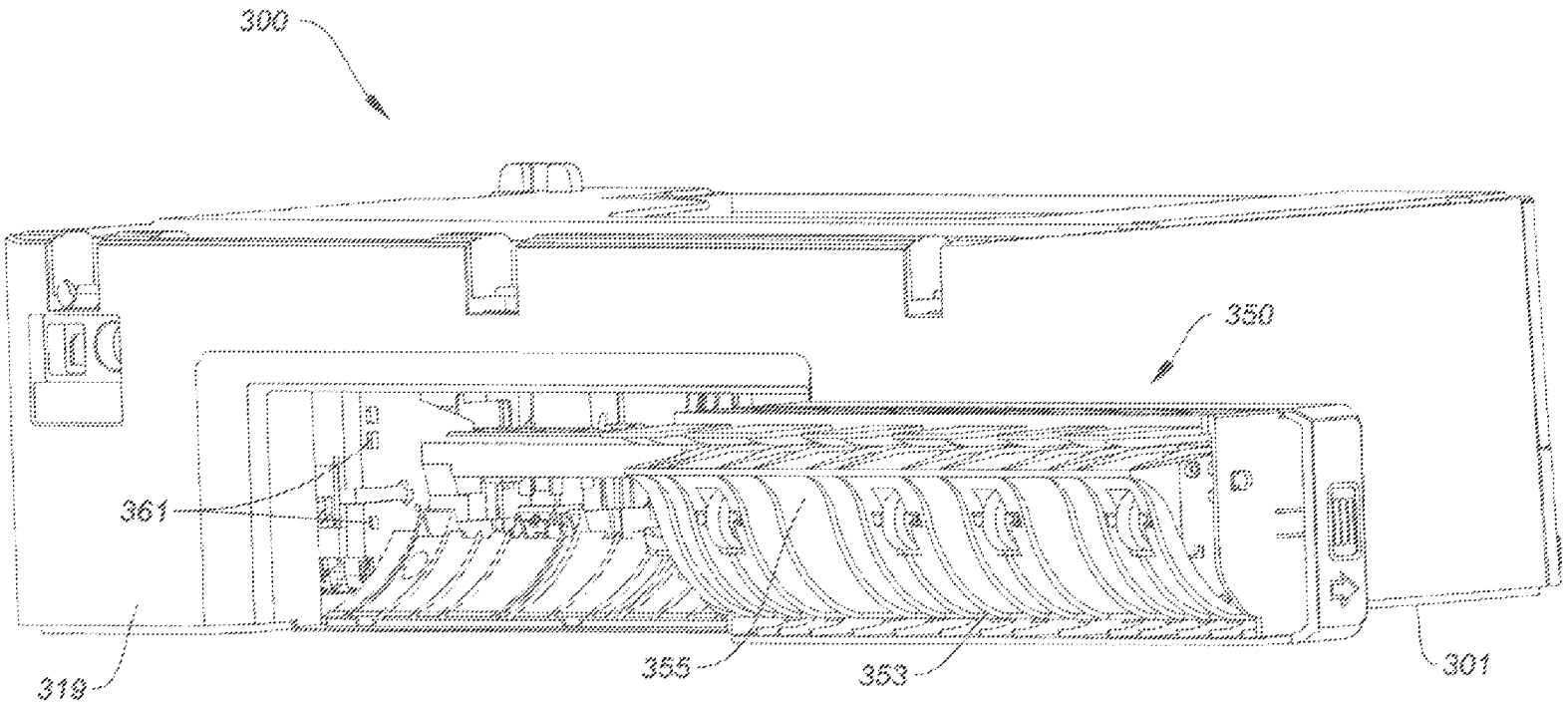
FIG. 15 is a rotated perspective view of the printing apparatus of FIG. 8.

FIG. 14 is a close up view of the end of pivotable duplexing unit 350 that includes pin member 344, spring member 367 and pegs 365. Shown more clearly in FIG. 14 is a D shape 346 of the end 345 of pin member 344. A round portion 347 of the D shape 346 is in contact with contact face 348 of support member 342 of hinge 340 (FIG. 12) when the pivotable duplexing unit 350 is latched in the closed position. The round portion 347 at the top of pin member 344 makes the contact described with the contact face 348 at the top of support member 342, and similarly contact is made between the round portion 347 at the bottom of pin member 344 with the contact face 348 at the bottom of support member 342. During unlatching, the pivotable duplexing unit 350 compresses spring member 367, and allows projections 360 (FIG. 13) to come out of corresponding holes 361 (FIG. 15). When duplexing unit 350 is pivoted with an unlatching force so that round portion 347 is no longer in contact with contact face 348, further freedom of movement is provided. It can also be seen in FIG. 14 that pin member 344 is part of outer cover member 356. The pivotable duplexing unit 350 and printer housing 319 and their components as described herein are typically formed by injection molding.

Figure 16:
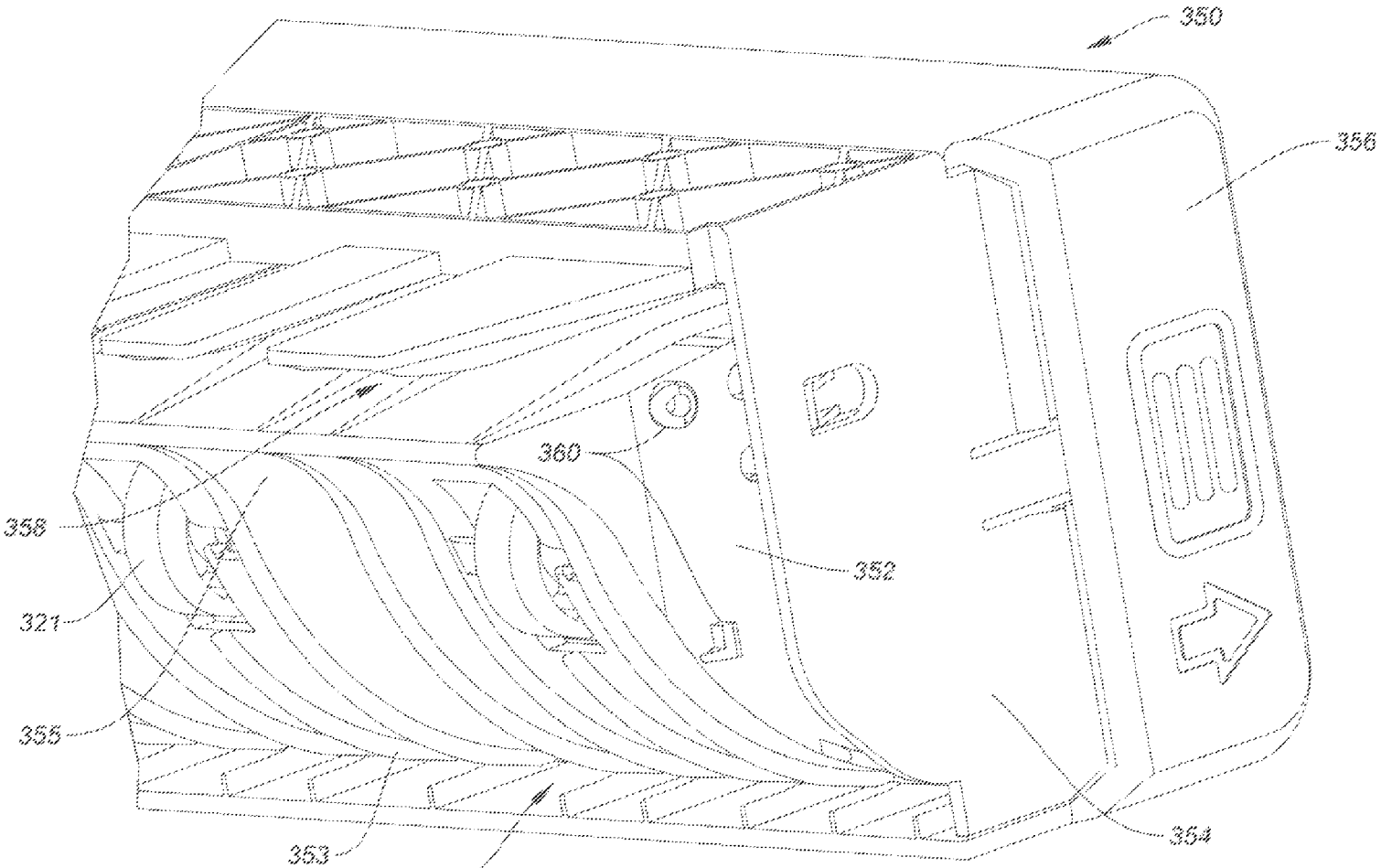
FIG. 16 is a perspective view of the pivotable duplexing unit of FIG. 8.

FIG. 15 shows a perspective view of printing apparatus 300 rotated in order to show holes 361 that serve as catches for latch projections 360. FIG. 16 is a close-up view of pivotable duplexing unit 350 at the end including latch projections 360. Comparing FIGS. 15 and 16 it can be seen that inner guide member 352 of pivotable duplexing unit 350 includes a first end including a projection 360 for latching the pivotable duplexing unit 350 in a closed position relative to wall 319 of printing apparatus 300, as well as a second end opposite the first end, where the second end includes a spring member 367 for biasing the projection 360 into a corresponding hole 361 when the pivotable duplexing unit 350 is in the closed position. It can also be seen that inner guide member includes a surface having a first curvature 353 (convex) near base 301, and a second curvature (concave) farther away from base 301, where the second curvature 355 has an opposite sense relative to the first curvature 353. Furthermore it can be seen that the inner guide member 352 includes a pinch roller 321 for holding a sheet of media against turn roller 322 (FIG. 4), where the pinch roller 321 is located near a portion of the surface having the second curvature 355.

Figure 17:
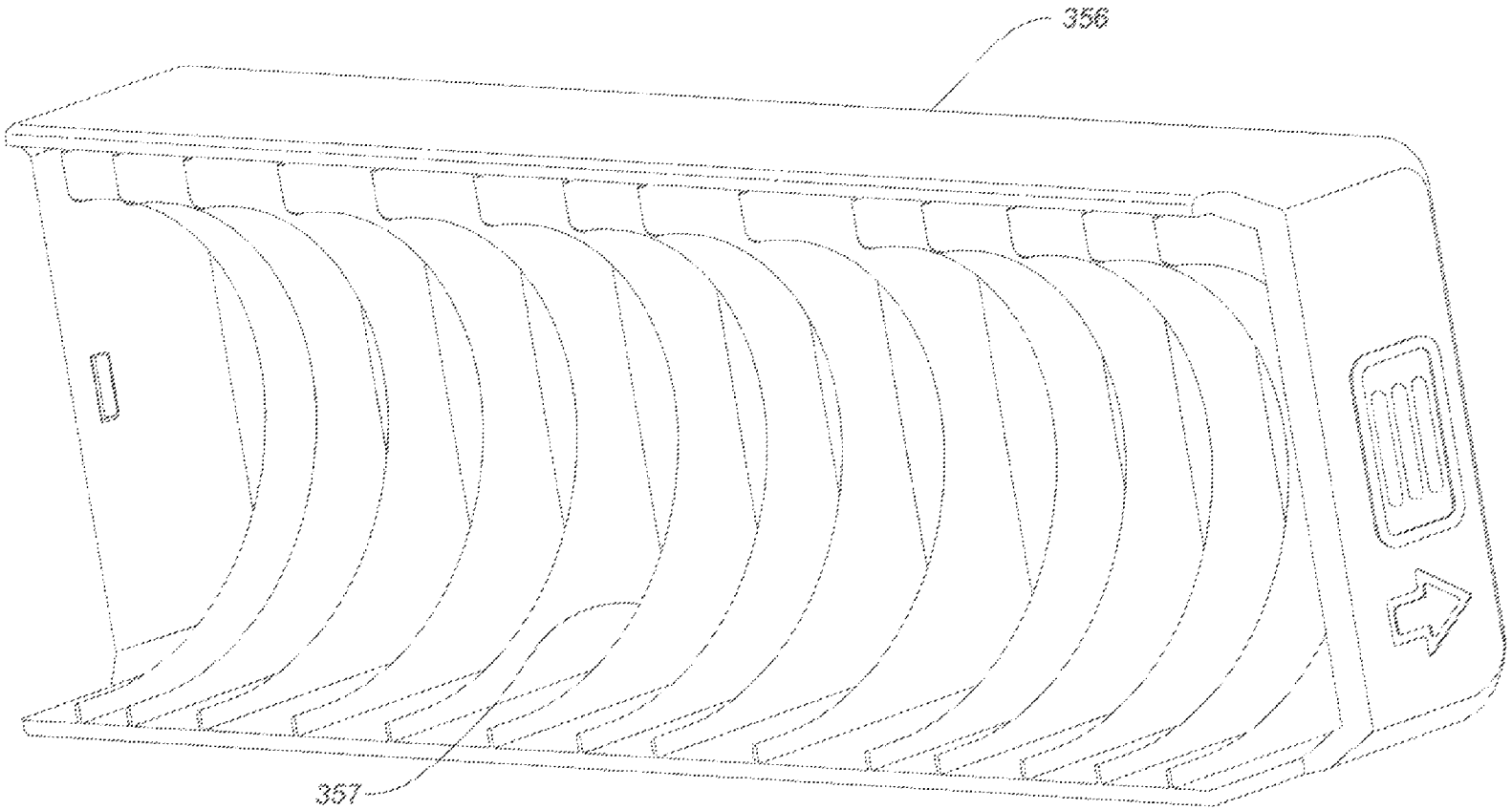
FIGS. 17-20 are perspective views of various portions of the pivotable duplexing unit of FIG. 8.
Figure 18:
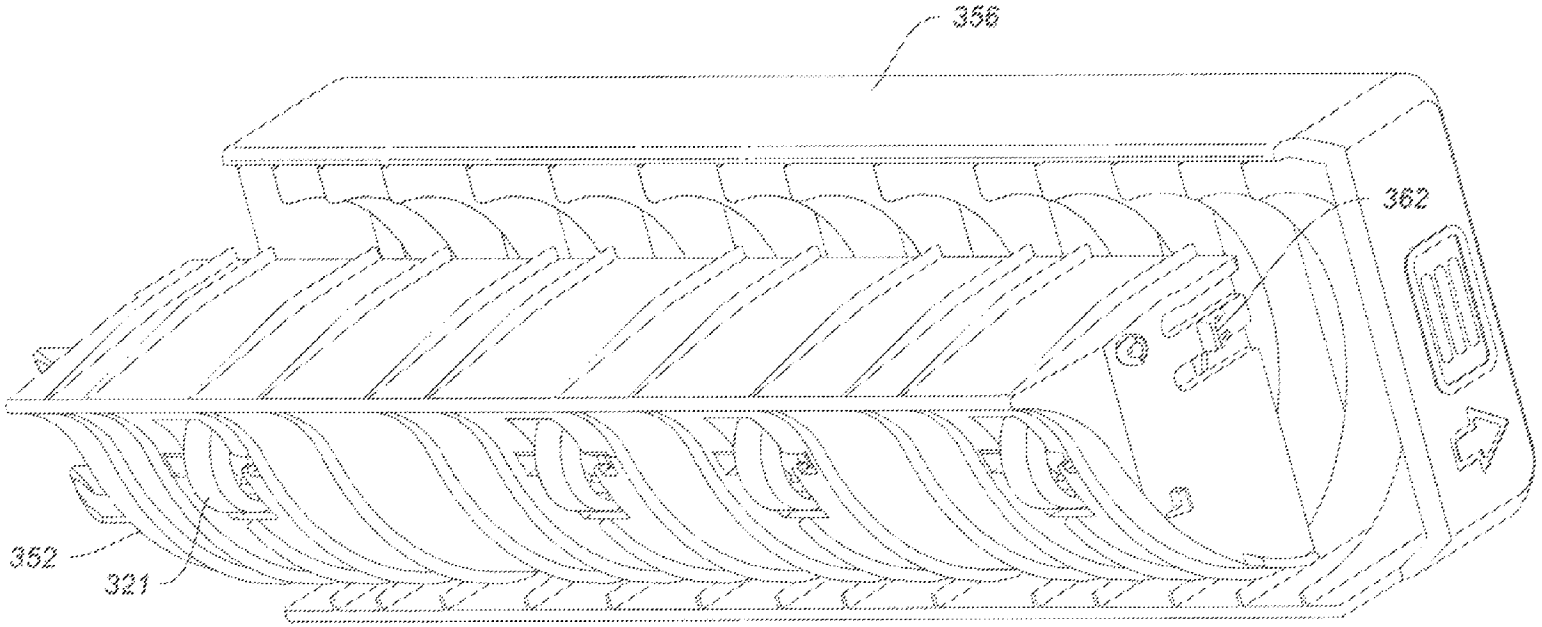
Figure 19:
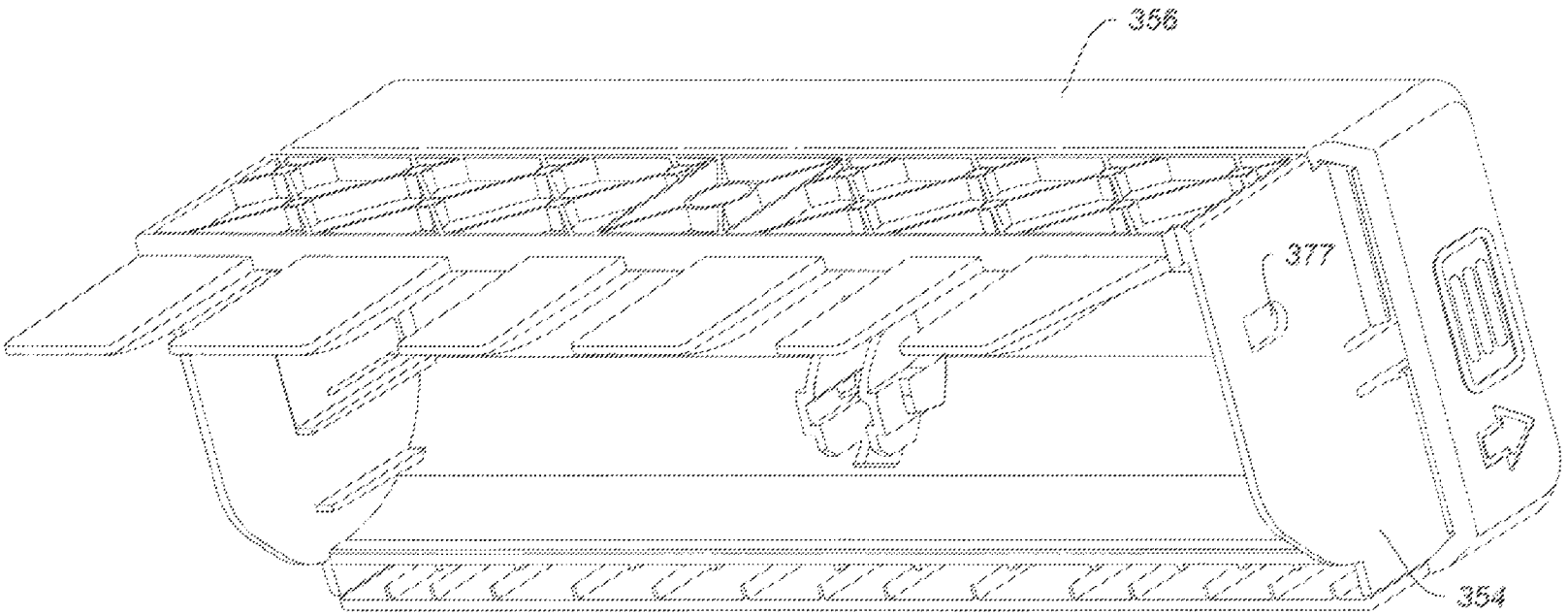
Figure 20:
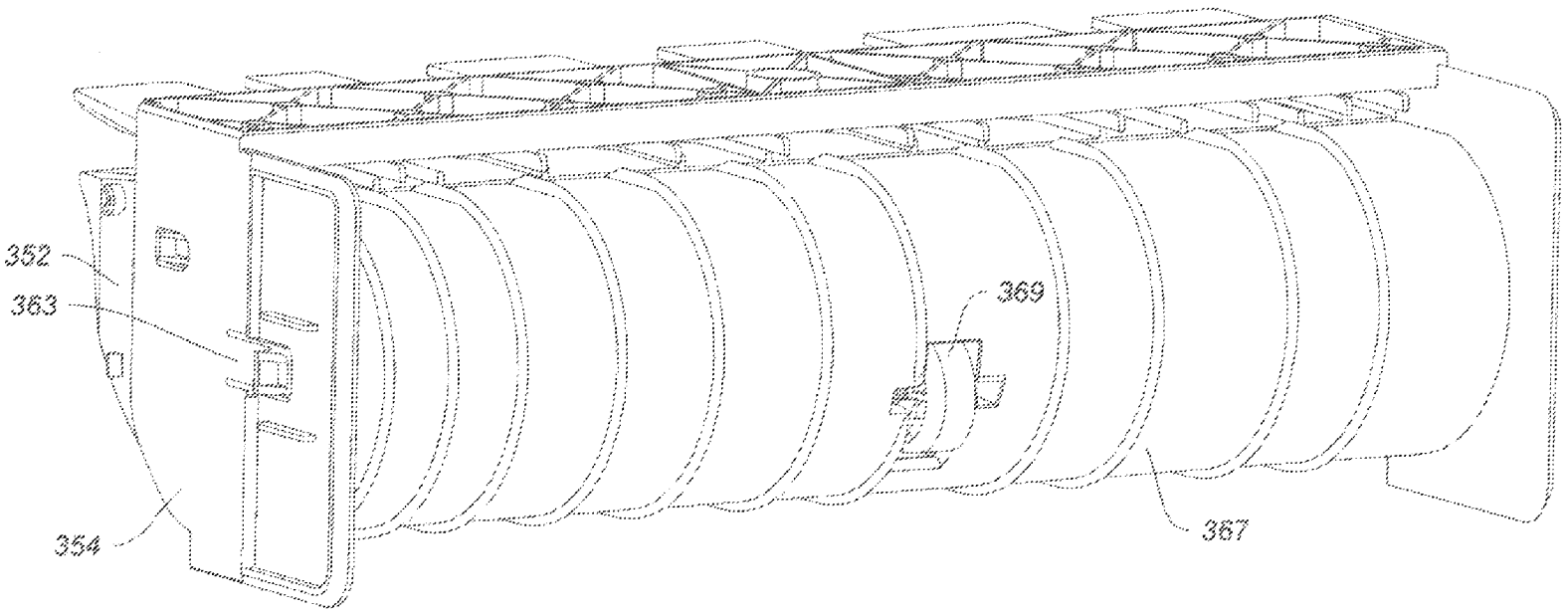

In the preferred embodiments shown in FIGS. 17-20, inner guide member 352, inner cover member 354 and outer cover member 356 of pivotable duplexing unit are shown as three separate units that are assembled together. FIG. 17 shows outer cover member 356 and its curved surface 357 shown schematically in FIGS. 4-7. Curved surface 357 is ribbed to reduce friction against media passing through duplexing unit 350. FIG. 18 shows inner guide member 352 spaced apart from outer cover member 356. Inner cover member 354 is hidden in this view in order to show latch 362 for affixing inner guide member 352 to inner cover member 354. FIG. 19 shows inner cover member 354 affixed to outer cover member 356 but with the inner guide member hidden in order to show catch 377 (corresponding to latch 362 of FIG. 18) on inner cover member 354. FIG. 20 shows inner guide surface 352 affixed to inner cover member 352 but with the outer cover member hidden and from a perspective rotated relative to FIG. 19, so that curved surface 367 of inner cover member 354 (also shown schematically in FIGS. 4-7) can be seen. Also shown in FIG. 20 is a latch 363 for affixing inner cover member 354 to outer cover member 356. FIG. 20 also shows an optional duplexing advance roller 369 described in further detail below.

Figure 21:
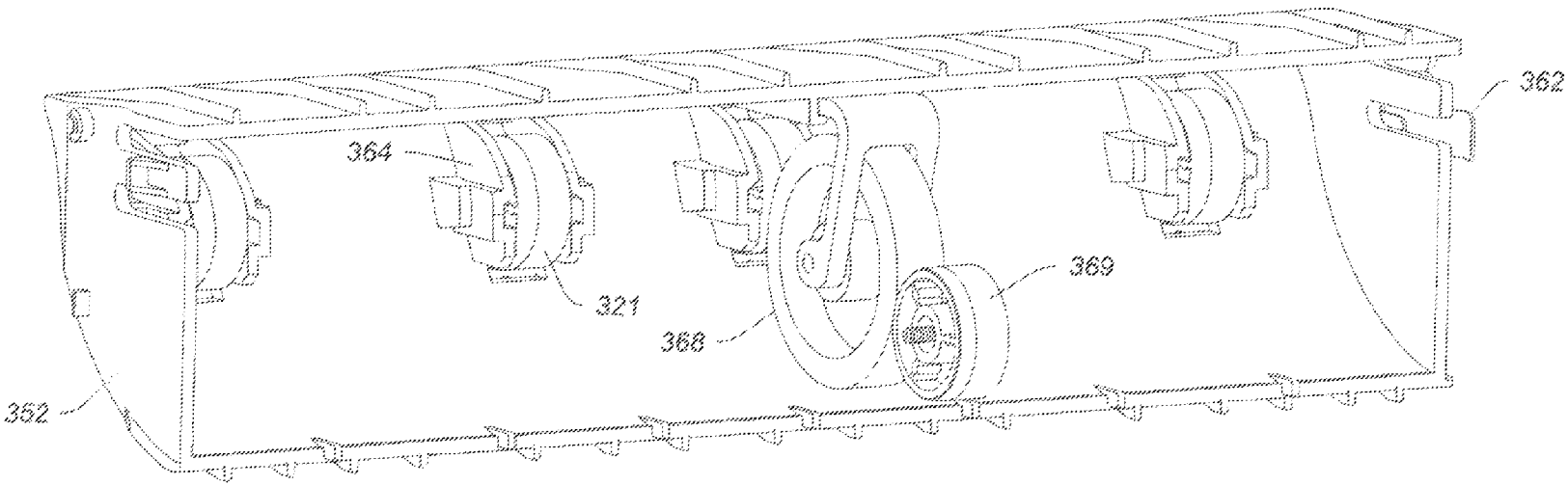
FIG. 21 is a perspective view of a portion of the pivotable duplexing unit of FIG. 8 according to another preferred embodiment of the invention.

FIG. 21 shows a perspective view of an preferred embodiment of inner guide member 352 from the same viewing angle as in FIG. 20, but with inner cover member 354 and outer cover member 356 hidden in order to show mounts 364 for pinch rollers 321. In this particular preferred embodiment, a friction wheel 368 is provided to transmit power from a pinch roller 321 to drive a duplexing advance roller 369. In this way a simple powered roller can be provided for moving a sheet of media through the duplexing unit without requiring gears for transmitting power to the roller.

The invention has been described in detail with particular reference to certain preferred embodiments thereof, but it will be understood that variations and modifications can be effected within the spirit and scope of the invention. In particular, although embodiments were described with regard to inkjet printers, the invention is applicable to other types of printing apparatus as well.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
250 Printhead chassis
251 Printhead die
253 Nozzle array
254 Nozzle array direction
256 Encapsulant
257 Flex circuit
258 Connector board
262 Multi-chamber ink tank
264 Single-chamber ink tank
300 Printing apparatus
301 Base
302 Paper load entry direction
303 Print region
304 Media advance direction
305 Carriage scan direction
306 Right side of printing apparatus
307 Left side of printing apparatus
308 Front of printing apparatus
309 Rear of printing apparatus
310 Hole (for paper advance motor drive gear)
311 Feed roller gear
312 Feed roller
313 Forward rotation direction (of feed roller)
314 Reverse rotation direction (of feed roller)
315 Media end sensor
316 Media input holder
317 Inclined guide
318 Media output holder
319 Wall
320 Pick roller
321 Pinch roller
322 Turn roller
323 Idler roller
324 Discharge roller
325 Star wheel(s)
330 Maintenance station
333 Upper surface
334 Access opening
335 Duplexing media support member
340 Hinge
341 Axis (of hinge)
342 Support member (of hinge)
343 Bearing surface
344 Pin member (of hinge)
345 End (of pin member)
346 D shape (of end of pin member)
347 Round portion (of D shape)
348 Contact face (of support member 342)
349 Screw holes
350 Duplexing unit
351 Duplexing media path
352 Inner guide member
353 First curvature (of inner guide member)
354 Inner cover member
355 Second curvature (of inner guide member)
356 Outer cover member
357 Curved surface (of outer cover member)
358 Entry (to duplexing unit)
359 Exit (from duplexing unit)
360 Projection (latch)
361 Hole (catch)
362 Latch (for affixing inner guide member to inner cover member)
363 Latch (for affixing inner cover member to outer cover member)
364 Mount(s) (for pinch rollers)
365 Peg
366 Hole (for peg)
367 Curved surface (of inner cover member)
368 Friction wheel
369 Duplexing advance roller
370 Stack of media
371 Top sheet of medium
372 First side (of sheet)
373 Second side (of sheet)
375 Lead edge (of sheet)
376 Trail edge (of sheet)
377 Catch (corresponding to latch 362)
380 Carriage motor
382 Carriage guide rail
383 Encoder fence
384 Belt
390 Printer electronics board
392 Cable connectors

The invention claimed is:

1. A printing apparatus comprising:

a base to support the printing apparatus during operation;

a wall extending at an angle from the base;

a print region;

a media input holder;

a media advance system for advancing media from the media input holder to the print region for printing on a first side of a sheet of media; and a pivotable duplexing unit comprising a duplexing media path for reversing the sheet of media in order to print on a second side of the sheet opposite the first side, wherein the pivotable duplexing unit is attached to the wall using a hinge having an axis that is substantially perpendicular to the base, and wherein the wall includes a support member of the hinge and the pivotable duplexing unit includes a pin member of the hinge for pivoting relative to the support member of the hinge.

2. The printing apparatus of claim 1, further including a first latch and catch for holding the pivotable duplexing unit in a closed position relative to the wall of the printing apparatus.

3. The printing apparatus of claim 1, wherein the support member of the hinge includes a bearing surface that is substantially parallel to the base, and wherein the pin member includes an end that makes pivotable contact with the bearing surface.

4. The printing apparatus of claim 3, the pivotable duplexing unit further comprising:

a first end including a projection for latching the pivotable duplexing unit in a closed position; and a second end opposite the first end, the second end including:

the pin member of the hinge; and a spring member for biasing the projection into a corresponding hole when the pivotable duplexing unit is in the closed position.

5. The printing apparatus of claim 4, the pin member including a D shape, wherein a round portion of the D shape is in contact with a face of the support member of the hinge when the pivotable duplexing unit is latched in the closed position.

6. The printing apparatus of claim 5, wherein the round portion of the D shape is not in contact with the face of the support member of the hinge when an unlatching force is applied to the first end of the pivotable duplexing unit.

7. The printing apparatus of claim 6, wherein a screw secures the pin member of the hinge into the support member of the hinge.

8. The printing apparatus of claim 1, the media input holder being substantially parallel to the base and located at a first plane proximate to the base, and the print region being substantially parallel to the base and located at a second plane distal to the base, the media advance system comprising:

a pick roller that is driven to advance a sheet of media from the media input holder;

a turn roller that is driven to further advance the sheet of media received from the pick roller toward the second plane; and a feed roller that is driven to further advance the sheet of media to the print region for printing on the first side.

9. The printing apparatus of claim 8 further comprising a media end sensor disposed between the turn roller and the feed roller.

10. The printing apparatus of claim 8, further comprising a duplexing media path support member, wherein the duplexing media support member faces the pivotable duplexing unit when the pivotable duplexing unit is in a closed position.

11. The printing apparatus of claim 10, the pivotable duplexing unit further comprising:

an inner guide member that is disposed adjacent the duplexing media support member when the pivotable duplexing unit is in a closed position;

an inner cover member that is disposed adjacent the inner guide member; and an outer cover member that is disposed adjacent the inner cover member.

12. The printing apparatus of claim 11, wherein the inner guide member includes a surface having a first curvature proximate the base and a second curvature distal to the base, the second curvature having an opposite sense relative to the first curvature.

13. The printing apparatus of claim 12, the inner guide member further including a pinch roller for holding a sheet of media against the turn roller, the pinch roller being located proximate a portion of the surface having the second curvature.

14. The printing apparatus of claim 11, the pivotable duplexing unit further comprising a second latch to affix the inner guide member to the inner cover member.

15. The printing apparatus of claim 11, the pivotable duplexing unit further comprising a third latch to affix the inner cover member to the outer cover member.

16. The printing apparatus of claim 11, the inner cover member including a curved surface and the outer cover member including a curved surface, wherein the curved surface of the inner cover member faces and is spaced apart from the curved surface of the outer cover member.

17. The printing apparatus of claim 1, the pivotable duplexing unit not including any rollers that are driven to advance the sheet of media through the duplexing media path.

18. The printing apparatus of claim 1, the pivotable duplexing unit including a duplexing advance roller that is driven by a friction wheel that contacts a pinch roller and the duplexing advance roller.

19. The printing apparatus of claim 11, wherein the outer cover member comprises the pin member that is part of the hinge.

20. The printing apparatus of claim 11, the inner guide member comprising:

a first end including a projection for latching the pivotable duplexing unit in a closed position relative to the wall of the printing apparatus; and a second end opposite the first end, the second end including a spring member for biasing the projection into a corresponding hole when the pivotable duplexing unit is in the closed position.

21. The printing apparatus of claim 1, the pivotable duplexing unit being located proximate to the base, the printing apparatus further comprising a scanning apparatus that is located distal to the base.

* * * * *